US008851919B2

(12) United States Patent
Schütz

(10) Patent No.: US 8,851,919 B2
(45) Date of Patent: Oct. 7, 2014

(54) ELECTRICAL PLUG CONNECTOR HAVING AN INSULATING BODY ROTATABLY AND SLIDABLY HELD CAPTIVE ON A PLUG HOUSING

(75) Inventor: Christian Schütz, Hille (DE)

(73) Assignee: Harting Electronics GmbH (DE)

( * ) Notice: Subject to any disclaimer, the term of this patent is extended or adjusted under 35 U.S.C. 154(b) by 0 days.

(21) Appl. No.: 13/699,588

(22) PCT Filed: May 30, 2011

(86) PCT No.: PCT/DE2011/075124

§ 371 (c)(1),
(2), (4) Date: Nov. 21, 2012

(87) PCT Pub. No.: WO2012/022313

PCT Pub. Date: Feb. 23, 2012

(65) Prior Publication Data

US 2013/0273769 A1 Oct. 17, 2013

(30) Foreign Application Priority Data

Jul. 28, 2010 (DE) ..... 20 2010 010 754 U

(51) Int. Cl.
*H01R 4/24* (2006.01)
*H01R 13/502* (2006.01)

(52) U.S. Cl.
CPC ..... *H01R 4/24* (2013.01); *H01R 4/2433* (2013.01); *H01R 13/502* (2013.01)
USPC ..... 439/405

(58) Field of Classification Search
CPC ..... H01R 9/0757
See application file for complete search history.

(56) References Cited

U.S. PATENT DOCUMENTS

| | | | | |
|---|---|---|---|---|
| 5,277,616 | A * | 1/1994 | Harting et al. | 439/417 |
| 5,989,056 | A | 11/1999 | Lange et al. | 439/412 |
| 6,267,617 | B1 | 7/2001 | Nozick | 439/417 |
| 6,347,956 | B2 | 2/2002 | Bogdan et al. | 439/411 |
| 6,955,557 | B2 | 10/2005 | Bernat et al. | 439/404 |

(Continued)

FOREIGN PATENT DOCUMENTS

| | | | |
|---|---|---|---|
| DE | 4203455 | 6/1993 | H01R 4/24 |
| DE | 29512585 | 1/1996 | H01R 4/24 |

(Continued)

OTHER PUBLICATIONS

German Search Report issued in corresponding application No. 20 2010 010 754.7, dated Jul. 25, 2011 (4 pgs).

(Continued)

*Primary Examiner* — Chandrika Prasad
(74) *Attorney, Agent, or Firm* — Hayes Soloway P.C.

(57) ABSTRACT

An insulating body is captively secured on the housing for a plug connection having insulation displacement terminals. The insulating body is held on guide of the housing in a rotatable manner and in an insertable manner into the housing via an opening. The guide can be formed as slits that lie in lateral parts of the housing. The lateral parts project beyond the housing. Electric conductors can be inserted into the insulating body on a rear surface, plugged through said body, and cut on a front surface. The electric conductors are thus brought to the intended length before the insulating body is inserted into the housing.

18 Claims, 5 Drawing Sheets

(56) References Cited

U.S. PATENT DOCUMENTS

| | | | | |
|---|---|---|---|---|
| 6,971,903 | B2 * | 12/2005 | Goto et al. | 439/404 |
| 7,021,956 | B2 * | 4/2006 | Goto et al. | 439/397 |
| 7,381,083 | B2 * | 6/2008 | Amidon | 439/418 |
| 7,473,141 | B2 * | 1/2009 | Liao | 439/638 |
| 7,563,125 | B2 * | 7/2009 | Pepe et al. | 439/417 |
| 8,568,157 | B2 * | 10/2013 | Bishop | 439/389 |
| 2008/0050975 | A1 | 2/2008 | Liao | 439/660 |
| 2010/0029129 | A1 * | 2/2010 | Cox et al. | 439/405 |
| 2011/0028025 | A1 | 2/2011 | Ferderer | 439/404 |

FOREIGN PATENT DOCUMENTS

| | | | |
|---|---|---|---|
| DE | 19811667 | 9/1999 | H01R 13/658 |
| DE | 10216491 | 8/2003 | H01R 24/00 |
| DE | 202007002051 | 5/2007 | H01R 27/02 |
| DE | 202008000941 | 4/2008 | H01R 4/24 |
| DE | 202008000942 | 4/2008 | H01R 4/24 |
| DE | 202009010246 | 11/2009 | H01R 4/24 |
| EP | 0554810 | 1/1993 | H01R 9/07 |
| EP | 1693934 | 8/2006 | H01R 24/58 |
| GB | 2029650 | 3/1980 | H01R 4/24 |
| JP | H05283112 | 10/1993 | |
| JP | 2000021540 | 1/2000 | |
| JP | 2000188155 | 7/2000 | H01R 12/08 |
| JP | 3134069 | 8/2007 | H01R 31/06 |
| TW | 537544 | 3/1991 | H01R 33/74 |

OTHER PUBLICATIONS

International Preliminary Report on Patentability, dated Feb. 7, 2013 (9 pgs).

International Search Report issued for corresponding application No. PCT/DE2011/075124, dated Dec. 20, 2011 (6 pgs).

International Search Report PCT/DE 2011/075124 dated May 30, 2011(11 pages) no English trans. available.

Japanese Communication (translated into German)P210-43 JP dated Dec. 16, 2013 (8 pgs) no Engl. trans. available.

German Communication 20 2010 010 754.7 dated Jul. 25, 2011 (4 pgs) no English translation available.

Korean Office Action (with translation) issued in application No. 10-2013-7005126, dated Mar. 19, 2014 (9 pgs).

* cited by examiner

ELECTRICAL PLUG CONNECTOR HAVING AN INSULATING BODY ROTATABLY AND SLIDABLY HELD CAPTIVE ON A PLUG HOUSING

BACKGROUND OF THE INVENTION

The invention relates to a plug connector for a plurality of electrical conductors, comprising a housing and an insulating body, wherein the insulating body for each electrical conductor has a guide channel with at least one deflecting bevel or deflecting rounded portion, and wherein the housing for each electrical conductor has a contact element for making contact with said electrical conductor, wherein these contact elements are provided in each case at at least one end with an insulation displacement terminal, and wherein the insulating body for each insulation displacement terminal has a pocket, which is provided for receiving the corresponding insulation displacement terminal when the insulating body is pushed into the housing, wherein the guide channel intersects the associated pocket in the region of the deflecting bevel or deflecting rounded portion of said guide channel, as a result of which each insulation displacement terminal makes contact with the associated electrical conductor, which is inserted into the respective guide channel and is therefore guided transversely through the pocket, by the insulating body being pushed into the housing.

Such an apparatus is required for making contact with electrical conductors using a plug connector.

PRIOR ART

A large number of solutions for making contact with electrical conductors in a plug connector by insulation displacement terminals is already known from the prior art.

For example, document EP0554810B1 discloses an electrical connector for connecting insulated electrical conductors. In order to make contact with the connector, all of the electrical conductors with which contact is to be made are inserted into a common pressure part in a first process step. Then, the electrical conductors are pressed into their respective insulation displacement terminals by actuation of the pressure part jointly in a second process step. This arrangement enables insertion of the electrical conductors, axially to the contact elements, and is suitable in particular for contact-making by machine.

Document DE202009010246U1 proposes a connection apparatus which can be made up in the field and with which a plurality of individual cores can be brought into contact with one another manually using a single tool and with little exertion of force at the point of use. For this purpose, a connection unit with a dedicated sliding block is provided for each core. For this, the core is inserted axially to the insulation displacement terminal into its respective connection unit.

In practice, it has been demonstrated that there is still a requirement for plug connectors which can be made up in the field and which make it possible to press a plurality of electrical conductors into their respective insulation displacement terminals in order to make contact with said electrical conductors in a common process step using a common insulating body. Unfortunately, in practice the problem occurs again and again that, when the insulating body is pushed into the housing, it is established that the insulating body is located in an incorrect orientation or that different insulating bodies of different plug connectors are inadvertently being swapped over. Finally, precisely one associated insulating body needs to be carried along for each housing and needs to be correspondingly assigned prior to the contact-making step.

SUMMARRY OF THE INVENTION

The invention is therefore based on the problem of specifying a connection apparatus of the type mentioned at the outset which can be made up in the field and which avoids the abovementioned problems.

This problem is solved in that the housing has an opening on one side, and in that the insulating body is held captively on the housing in the region of this opening, wherein the insulating body and the housing can be plugged with one another.

The invention concerns an apparatus which is required for making contact between a plurality of electrical conductors in a common process step with a plug connector.

Advantageously, the insulating body is in the form of a right parallelepiped and has, on two mutually opposite side faces, in each case one cylindrical pin. These two pins engage in each case in a guide means of the housing, wherein the guide means is preferably in the form of a rail or a slot and said guide means are arranged on two mutually opposite side parts of the housing. It is particularly advantageous here if the side parts are configured such that they protrude beyond the opening in the housing. This has the advantage that the insulating body is firstly held captively on the housing and secondly can be inserted into the housing with its pins sliding along the two guide means.

Furthermore, it is particularly advantageous here if each guide means has a rear end, which is arranged in that region of the associated side part which protrudes beyond the opening in the housing.

In order to receive and guide each electrical conductor, the insulating body has in each case one guide channel. This guide channel has a deflecting bevel or deflecting rounded portion.

Furthermore, the insulating body has a pocket, which is intersected by the guide channel in the region of the deflecting bevel or deflecting rounded portion. Thus, an electrical conductor which has been pushed through the guide channel is guided transversely through the pocket in the region of the deflecting bevel or deflecting rounded portion. When the insulating body is pressed into the housing, each pocket receives the associated insulation displacement terminal and contact is made with the corresponding electrical conductor by the associated insulation displacement terminal.

It is furthermore particularly advantageous if the insulating body is held moveably with its pins in each case one guide means and is mounted rotatably with these pins at least at the rear end of the guide means. Advantageously, the rear end of the guide means is semicircular, as a result of which the frictional forces on rotation of the insulating body about its pins, when said pins are located at the rear end of the guide means, are reduced. The rotatable bearing arrangement has the advantage that the electrical conductors which can first be inserted into the respective guide channel and pushed through a rear opening in a rear face of the insulating body, with the result that said electrical conductors emerge out of a front opening again, which front opening is located in a front face of the insulating body, and are cut there and are therefore brought to the intended length. It is advantageous here if the front face and the rear face of the insulating body are arranged opposite one another and at right angles to the two side faces. Correspondingly, each electrical conductor has substantially an axial profile with respect to the contact element when the insulating body is pressed into the housing, i.e. said electrical conductor only deviates from this axial alignment with respect to the insulation displacement terminal in the region of the deflecting bevels or deflecting rounded portions in order for it to be possible for contact to be made with said electrical conductor in this region by the insulation displacement terminal.

BRIEF DESCRIPTION OF THE DRAWINGS

An exemplary embodiment of the invention is illustrated in the drawing and will be explained in more detail below. In the drawings.

DETAILED DESCRIPTION OF THE INVENTION

Figure 1:
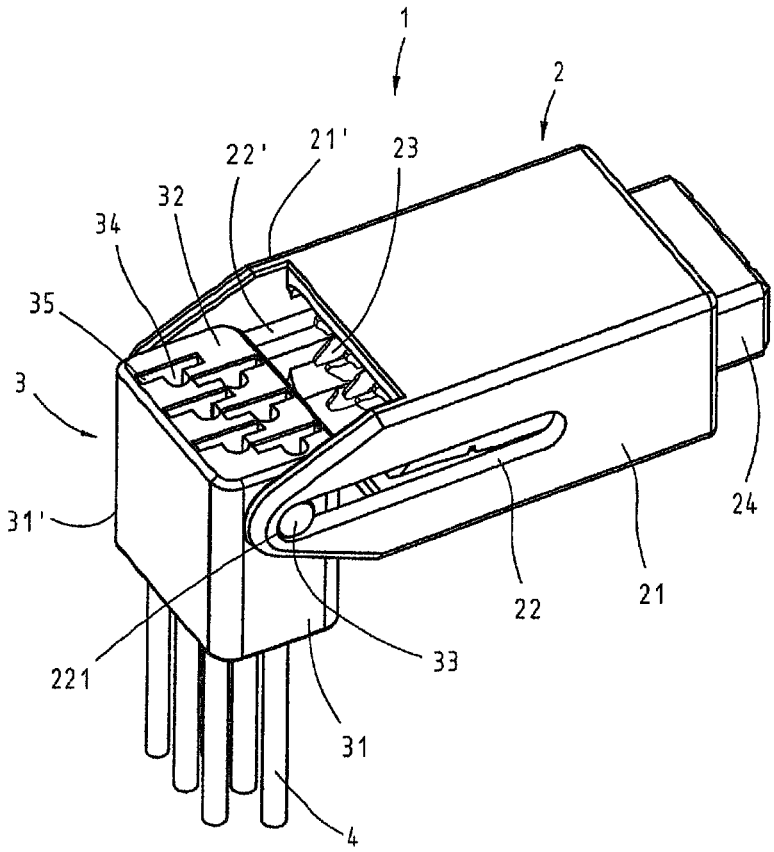
FIG. 1 shows a plug connector with a bent-back insulating body which has not been inserted.

FIG. 1 represents a plug connector 1. This plug connector 1 comprises a housing 2 and an insulating body 3. The housing 2 has an opening in one side and has two side parts 21, 21', which protrude beyond this opening tapering to a point on one side. These side parts each have a slot 22, 22'. Each slot has a rear end 221, 221', which is located in that region of the side part which tapers to a point and which protrudes beyond the opening in the housing. In this case, only the rear end of the first slot 221 is illustrated in the drawing because the rear end of the second slot 221' is hidden by the insulating body. The two slots 22, 22' are located in the region of the opening in the housing 2.

Furthermore, the housing 2 has a plurality of contact elements, with in each case one insulation displacement terminal 23 located at one end of said contact elements.

The housing 2 has a plug part 24 on a side opposite the opening.

The insulating body 3 is in the form of a right parallelepiped and has in each case one first and one second side face 31, 31' on two opposite sides. Said insulating body has a front face 32 and a rear face 32' at right angles to said first and second side faces.

The insulating body 3 has in each case one cylindrical pin on the side faces 31, 31', of which pins only the first pin 33 is illustrated in the drawing because the second pin is hidden in the drawing by the insulating body 3 and is therefore not shown in the diagram. The second pin is identical to the first pin 33 and is arranged symmetrically thereto on the second side face 31'.

The insulating body 3 engages with these two pins 33 in the respective slot 22, 22' and is therefore held captively on the housing 2. Furthermore, the insulating body 3 is mounted rotatably about an axis running through the two pins 33. This is the case in particular when the two pins 33 are located at the rear end 221, 221' of the respective slot 22, 22'. The rear end 221, 221' of the slots 22, 22' is semicircular, with the result that the axis then passes through the center point of these semicircles.

Furthermore, a plurality of electrical conductors 4 inserted into the insulating body 3 are illustrated. The insulating body 3 has a front face 32 with front openings 34 for the electrical conductors 4 to emerge. As long as the insulating body 3 with the electrical conductors 4 inserted, as illustrated in FIG. 1, is aligned at a sharp angle with respect to the axis of the insulation displacement terminals 23, the electrical conductors 4 can emerge from the front openings 34 in the front face 32 and be cut to a suitable length there.

Adjacent to each of the front openings 34, the insulating body has in each case one pocket 35. This pocket 35 is provided for receiving in each case one insulation displacement terminal 23.

Figure 2:
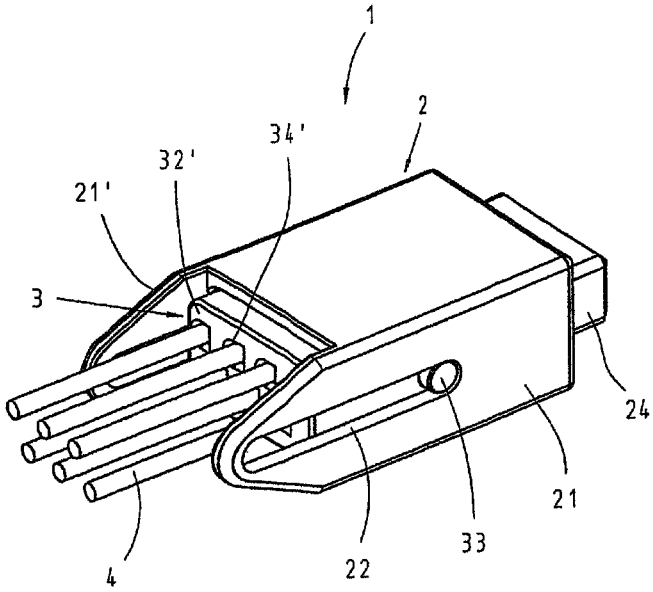
FIG. 2 shows the plug connector with an insulating body which has been pressed into the housing.

FIG. 2 illustrates the plug connector 1 with an insulating body 3 pressed into the housing 2. For this purpose, starting from the illustration shown in FIG. 1, the insulating body 3 is first rotated virtually through 90° about its pins 33 located at the rear end 221, 221' of the slots 22, 22' and then inserted into the housing 2 along the slots 22, 22' and pressed in.

In this case, the insulating displacement terminals 23 are inserted into the pockets and make contact with the electrical conductors 4 which have previously been inserted into in each case one rear opening 34' at a rear face 32' and have been guided substantially longitudinally to the insulation displacement terminals 23 through the insulating body 3.

Figure 3:
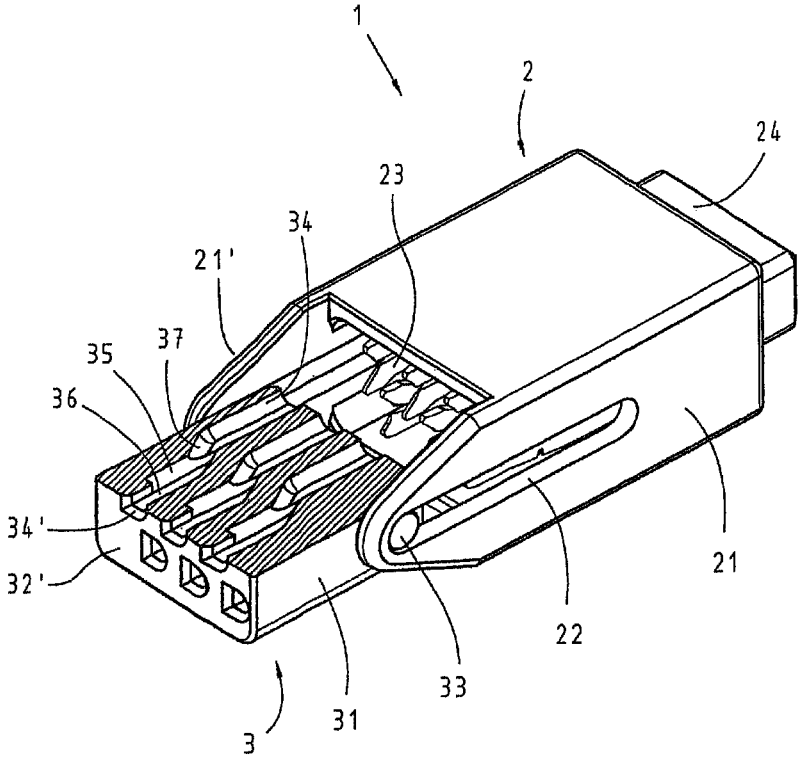
FIG. 3 shows the plug connector with an insulating body which has not been inserted, as is shown in a partial section through the upper guide channels, in a side view at an angle.
Figure 4:
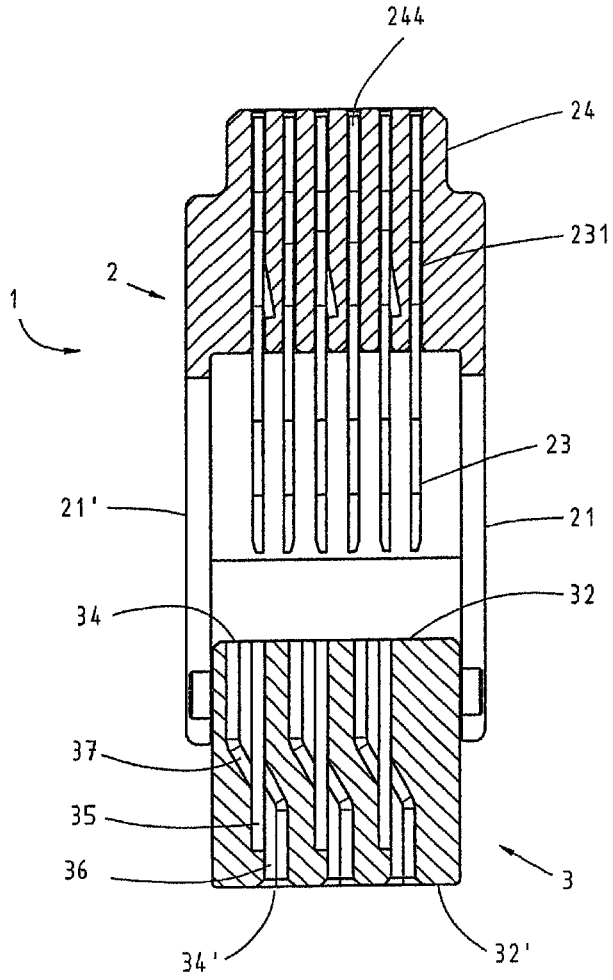
FIG. 4 shows the plug connector with the insulating body shown in section not inserted, in a plan view.

In addition to this, FIG. 3 and FIG. 4 illustrate the plug connector 1 with an insulating body 3 which is already rotated in comparison with that shown in FIG. 1 but has not yet been inserted, in contrast to that shown in FIG. 2, in a side view at an angle and in plan view. In this case, the insulating body is illustrated in each case in a section running through three of its guide channels 36, namely three upper guide channels 36.

The profile of the guide channels 36 in connection with the pockets 35 and the insulation displacement terminals 23 is clearly visible in particular in FIG. 4.

Starting with a rear opening 34' in the rear face 32', the guide channel 36 first runs in a straight line and then becomes the deflecting bevel 37, approximately in the center of the insulating body 3. In the region of this deflecting bevel 37, said guide channel intersects the pocket 35. As its profile continues, the guide channel 36 again passes from the deflecting bevel 37 into a straight profile which tapers parallel to the original profile to the front opening 34 which is located in the front face 32.

In this case, it can clearly be seen that the electrical conductors 4 run within the insulating body 3 substantially in the direction of the insulation displacement terminals 23.

It can further be seen that the insulation displacement terminals 23 are electrically conductively connected to contacts 244 arranged in the plug part 24 via an electrical connection 231.

Figure 5:
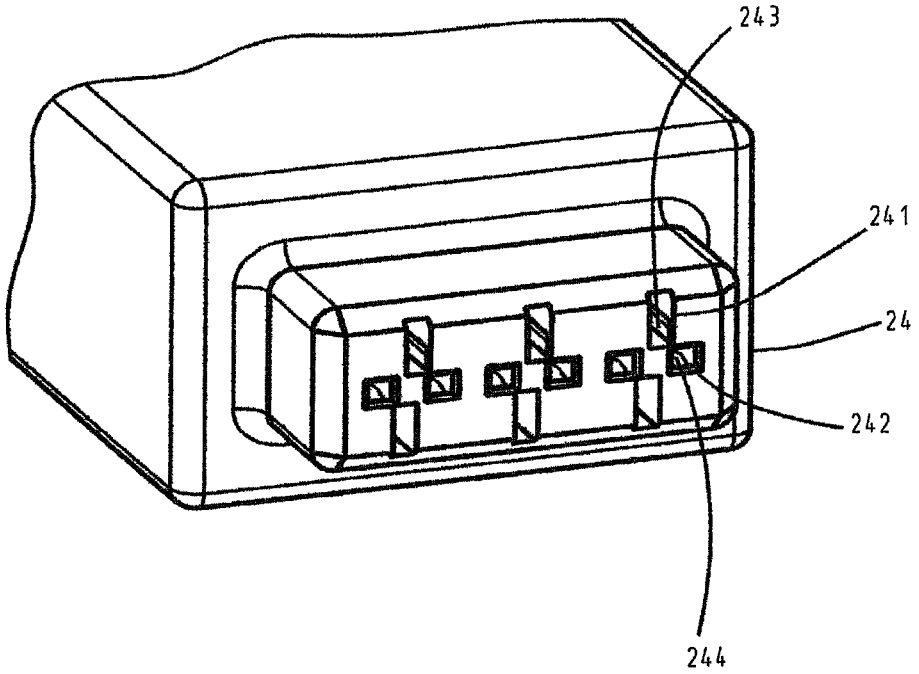
FIG. 5 shows a plug part associated with the housing with its plug face.

FIG. 5 illustrates the plug part 24 with its plug face. The plug face has contact openings 242 and latching openings 241. Electrical contacts 244 are arranged in the contact openings 242, and latching means 243 are arranged in the latching openings 241.

LIST OF REFERENCE SYMBOLS

1 Plug connector
2 Housing
21, 21' Side parts
22, 22' Slots
221, 221' Rear end of slots
23 Insulation displacement terminal
231 Electrical connection
24 Plug part
241 Latching cutout
242 Contact opening
243 Latching means

244 Electrical contacts
3 Insulating body
31, 31' Side faces
32 Front face
32' Rear face
33 Pins
34 Front opening
34' Rear opening
35 Pocket
36 Guide channel
37 Deflecting bevel
4 Electrical conductors

The invention claimed is:

1. A plug connector for a plurality of electrical conductors, comprising a plug housing and an insulating body;

said insulating body for each electrical conductor comprising a guide channel comprising first, second and third channel portions, wherein the first and the third channel portions are offset parallel to one another, and the second channel portion comprises a deflecting bevel or a deflecting rounded portion connecting the first and third portions;

said plug housing for each electrical conductor comprising a plug part at a first end, said plug part comprising at least one contact opening in communication with at least one contact element for making contact with said electrical conductor, wherein each of the at least one contact elements is conductively connected to an insulation displacement terminal at a second, opposite end of the housing from the plug part;

said insulating body further comprising a pocket for each insulation displacement terminal, said pocket provided for receiving the corresponding insulation displacement terminal when the insulating body is pushed into the housing, wherein the guide channel intersects the associated pocket in the region of the deflecting bevel or deflecting rounded portion of said guide channel, as a result of which each insulation displacement terminal makes contact with the associated electrical conductor, which is inserted into the respective guide channel and is therefore guided transversely through the pocket, by the insulating body being pushed into the plug housing;

said plug housing further comprising an opening at the second end, wherein the insulating body is rotatably and slidably held captively on the plug housing in the region of this opening by a pin and guide arrangement, wherein the insulating body and the plug housing can be plugged with one another; and said insulating body further comprising on each of two mutually opposite side faces one cylindrical pin, and said plug housing further comprising two guides, into which the two pins directly engage, or the plug housing further comprising, on each of two mutually opposite side faces, one cylindrical pin, and said insulating body further comprises two guides, wherein the insulating body is directly held captively with its pins in the guides and can be pushed along the guides into the plug housing.

2. The plug connector as claimed in claim 1, wherein the guides comprise two slots arranged in two mutually opposite side parts of the plug housing or the insulating body, as the case may be.

3. The plug connector as claimed in claim 2, wherein the side parts protrude beyond the opening in the plug housing, and in that the two slots each have a rear end which is located in that region of the side parts which protrudes beyond the opening at the second end in the plug housing.

4. The plug connector as claimed in claim 3, wherein the rear ends of the slots are semicircular.

5. The plug connector as claimed in claim 1, wherein the insulating body or the plug housing is mounted into the two guides, as the case may be.

6. The plug connector as claimed in claim 5, wherein the insulating body is mounted at the rear ends of the guides, rotatably about an axis running through the two pins of said insulating body.

7. A plug connector for a plurality of electrical conductors, comprising a plug housing and an insulating body;

said insulating body for each electrical conductor comprising a guide channel comprising first, second and third channel portions, wherein the first and the third channel portions are offset parallel to one another, and the second channel portion comprises a deflecting bevel or a deflecting rounded portion connecting the first and third portions;

said plug housing for each electrical conductor comprising at least one contact element for making contact with said electrical conductor, wherein each of the at least one contact elements is conductively connected to an insulation displacement terminal;

said insulating body further comprising a pocket for each insulation displacement terminal, said pocket provided for receiving the corresponding insulation displacement terminal when the insulating body is pushed into the plug housing, wherein the guide channel intersects the associated pocket in the region of the deflecting bevel or deflecting rounded portion of said guide channel, as a result of which each insulation displacement terminal makes contact with the associated electrical conductor, which is inserted into the respective guide channel and is therefore guided transversely through the pocket, by the insulating body being pushed into the plug housing; and said plug housing further comprising a first opening on one side, and a plug part having a plug face on a side opposite the first opening, said plug part comprising at least one contact opening in communication with the contact element and at least one latching opening with a latch arranged in the at least one latching opening, wherein the at least one contact opening is distinct from the at least one latching opening and wherein the insulating body is rotatably and slidably directly held captively on the plug housing in the region of the first opening, whereupon the insulating body and the plug housing can be plugged with one another.

8. The plug connector as claimed in claim 7, wherein the insulating body has, on each of two mutually opposite side faces, one cylindrical pin, and in that the housing has two guides, into which the two pins engage in each case.

9. The plug connector as claimed in claim 8, wherein the insulating body is held captively with its pins in the guides and can be pushed along the guides into the plug housing.

10. The plug connector as claimed in claim 8, wherein the guides comprise two slots arranged in two mutually opposite side parts of the plug housing.

11. The plug connector as claimed in claim 10, wherein the side parts protrude beyond the first opening in the plug housing, and in that the two slots each have a rear end which is located in that region of the side parts which protrudes beyond the first opening in the plug housing.

12. The plug connector as claimed in claim 11, wherein the rear ends of the slots are semicircular.

13. The plug connector as claimed in claim 8, wherein the insulating body is mounted into the two guides.

14. The plug connector as claimed in claim 13, wherein the insulating body is mounted at the rear ends of the guides, rotatably about an axis running through the two pins of said insulating body.

15. The plug connector as claimed in claim 9, wherein the insulating body is mounted in the two guides.

16. The plug connector as claimed in claim 10, wherein the insulating body is mounted in the two guides.

17. The plug connector as claimed in claim 11, wherein the insulating body is mounted in the two guides.

18. The plug connector as claimed in claim 12, wherein the insulating body is mounted in the two guides.

* * * * *